US007467084B2

(12) United States Patent
Finn et al.

(10) Patent No.: US 7,467,084 B2
(45) Date of Patent: Dec. 16, 2008

(54) DEVICE AND METHOD FOR OPERATING A VOICE-ENHANCEMENT SYSTEM

(75) Inventors: Brian Michael Finn, East Palo Alto, CA (US); Shawn K. Steenhagen, Cottage Grove, WI (US)

(73) Assignees: Volkswagen AG, Wolfsburg (DE); Audi AG, Ingolstadt (DE)

( * ) Notice: Subject to any disclaimer, the term of this patent is extended or adjusted under 35 U.S.C. 154(b) by 972 days.

(21) Appl. No.: 10/360,889

(22) Filed: Feb. 7, 2003

(65) Prior Publication Data

US 2004/0158460 A1 Aug. 12, 2004

(51) Int. Cl.
*G10L 21/00* (2006.01)

(52) U.S. Cl. ..... 704/224; 381/56

(58) Field of Classification Search ..... 704/224–227
See application file for complete search history.

(56) References Cited

U.S. PATENT DOCUMENTS

| | | | | |
|---|---|---|---|---|
| 5,574,824 | A * | 11/1996 | Slyh et al. | 704/226 |
| 5,615,302 | A * | 3/1997 | McEachern | 704/209 |
| 5,638,074 | A * | 6/1997 | Johnson | 341/155 |
| 5,872,531 | A * | 2/1999 | Johnson et al. | 341/110 |
| 5,920,840 | A * | 7/1999 | Satyamurti et al. | 704/267 |
| 6,674,865 | B1 * | 1/2004 | Venkatesh et al. | 381/107 |

FOREIGN PATENT DOCUMENTS

| | | |
|---|---|---|
| DE | 39 25 589 | 2/1991 |
| DE | 41 06 405 | 9/1991 |
| DE | 197 05 471 | 7/1997 |
| DE | 199 58 836 | 5/2001 |
| EP | 0 078 014 | 5/1983 |
| EP | 0 903 726 | 3/1999 |
| EP | 1 077 013 | 11/1999 |
| WO | WO 97/34290 | 9/1997 |
| WO | WO 98/56208 | 12/1998 |
| WO | WO 02/21817 | 3/2002 |
| WO | WO 02/32356 | 4/2002 |
| WO | WO 02/069487 | 9/2002 |

* cited by examiner

*Primary Examiner*—Michael N Opsasnick
(74) *Attorney, Agent, or Firm*—Kenyon & Kenyon LLP

(57) ABSTRACT

A method and a device are for operating a voice-enhancement system, such as a communication and/or intercom/two-way intercom or duplex telephony device in a motor vehicle. The device includes at least one microphone and at least one loudspeaker for reproducing a signal generated by the microphone, as well as a bandpass filter configured between the microphone and the loudspeaker. The bandpass filter is adjusted as a function of a comparison between the power of the signal generated by the microphone at a test frequency, and the power of the signal generated by the microphone at an at least substantially integral multiple of the test frequency, or as a function of a comparison between the power of the signal generated by the microphone at a test frequency, and the power of the signal generated by the microphone at the test frequency at at least an earlier point in time.

56 Claims, 10 Drawing Sheets

DEVICE AND METHOD FOR OPERATING A VOICE-ENHANCEMENT SYSTEM

FIELD OF THE INVENTION

The present invention relates to a method and to a device for operating voice-enhancement systems, such as communication and/or intercom/two-way intercom or duplex telephony devices in motor vehicles, in which voice signals are picked up via a microphone system and routed to at least one loudspeaker.

BACKGROUND INFORMATION

Methods of, this kind are used in motor vehicles for voice-enhancement duplex telephony or for supporting voice input-controlled electronic or electrical components. The fundamental difficulty that arises is that, depending on the particular operating state, background noise is present in a motor vehicle. It masks the voice commands. Intercom and two-way intercom or duplex telephony systems in motor vehicles are mainly used in large vehicles, minibuses, etc. However, they may also be used in normal passenger cars. When using voice-controlled input units for electrical components in motor vehicles, it is may be important for the background noise to be suppressed or for the voice command to be filtered out.

A voice-recognition device for a motor vehicle is described in European Published Patent Application No. 0 078 014, in which the status of engine operation and/or motor vehicle movement is signaled or fed in, via sensors, to the amplifier system of the voice-recognition device. Based on this, a noise-level control is used to attempt to filter out the voice command from the background noise.

A filtering operation is described in International Published Patent Application No. WO 97/34290, where periodic interfering noise signals are filtered out by determining their periods and by using a generator to interfere with them, so that the voice signal remains.

In German Published Patent Application No. 197 05 471, it is described to support a voice recognition with the aid of transversal filtering.

In German Published Patent Application No. 41 06 405, a method is described for subtracting noise from the voice signal, a multiplicity of microphones being used. A duplex telephony device having a plurality of microphones is described in German Published Patent Application No. 199 58 836.

In German Published Patent Application No. 39 25 589, it is described to use a multiple microphone system, in which, in motor vehicle applications, one of the microphones is placed in the engine compartment and one other microphone in the passenger compartment. A subtraction of both signals then follows. A disadvantage in this context is that only the engine noise or the actual running noise of the vehicle itself is subtracted from the total signal in the passenger compartment. Specific secondary noises are disregarded in this case. Also lacking is a feedback suppression. Everywhere that microphones and loudspeakers are placed in acoustically coupleable vicinity, the acoustic signal that is extracted, coupled out or decoupled at the loudspeaker is fed back, in turn, into the microphone. The result is a so-called feedback, and a subsequent overmodulation. Methods for avoiding such an overmodulation are described in European Published Patent Application No. 1 077 013, International Published Patent Application No. WO 02/069487 and International Published Patent Application No. WO 02/21817.

It is an object of the present invention to provide a method and a device that may improve the verbal communication among the occupants of a vehicle.

SUMMARY

The above and other beneficial objects of the present invention may be achieved by providing a method and a device as described herein.

In this context, to operate a voice-enhancement system, such as a communication and/or intercom/two-way intercom or duplex telephony device in a motor vehicle, using at least one microphone and at least one loudspeaker to reproduce a signal generated by the microphone, as well as a bandpass filter configured between the microphone and the loudspeaker, the bandpass filter is adjusted as a function of a comparison between the power of the signal generated by the microphone at a test frequency, and the power of the signal generated by the microphone at an at least substantially integral multiple, thus at essentially a harmonic of the test frequency, or as a function of a comparison between the power of the signal generated by the microphone at a test frequency, and the power of the signal generated by the microphone at a test frequency at at least an earlier point in time. One or more frequencies of the signal generated by the microphone may be suitable as a test frequency. In an example embodiment of the present invention, the frequency at which the power of the signal generated by the microphone is mainly at its maximum, is selected as a test frequency. Alternatively, a plurality of frequency components having substantial power are selected as test frequencies.

In another example embodiment of the present invention, the bandpass filter is adjusted both as a function of a comparison between the power of the signal generated by the microphone at the test frequency, and the power of the signal generated by the microphone at an at least substantially integral multiple of the test frequency, as well as as a function of a comparison between the power of the signal generated by the microphone at the test frequency, and the power of the signal generated by the microphone at the test frequency at at least an earlier point in time.

In another example embodiment of the present invention, the bandpass filter is set to block the component of the signal generated by the microphone, using a stop frequency, (only) when the power of the signal generated by the microphone at the test frequency is greater by more than an upper limiting value than the power of the signal generated by the microphone at the first harmonic of the test frequency. Stop frequency in the context of the present invention may also be a frequency range and not just a single frequency.

In another example embodiment of the present invention, the upper limiting value is between 20 and 40 dB. The upper limiting value may amount to, e.g., approximately 30 dB.

In yet another example embodiment of the present invention, the bandpass filter is set so as not to block the component of the signal generated by the microphone, using the stop frequency, when the power of the signal generated by the microphone at the test frequency is greater by less than a lower limiting value than the power of the signal generated by the microphone at the first harmonic of the test frequency.

In another example embodiment of the present invention, the lower limiting value may be between 5 and 20 dB. The lower limiting value may amount to, e.g., approximately 12 dB.

In another example embodiment of the present invention, by comparing the power of the signal generated by the microphone at the test frequency with the power of the signal generated by the microphone at the test frequency at at least earlier points in time, it may be decided whether the power of the signal generated by the microphone at the test frequency is increasing exponentially.

In yet another example embodiment of the present invention, the bandpass filter is set to block the component of the signal generated by the microphone, at the stop frequency, when the decision is made that the power of the signal generated by the microphone at the test frequency is increasing exponentially.

In another example embodiment of the present invention, the bandpass filter is set to block the component of the signal generated by the microphone, using a stop frequency, (only) when the power of the signal generated by the microphone at the test frequency is greater than a response threshold for longer than a first response time, the first response time, e.g., being greater than, e.g., approximately 750 ms.

In yet another example embodiment of the present invention, the power is determined at more than one test frequency, and the bandpass filter is set to block the component of the signal generated by the microphone, using the stop frequency, only when the power of the signal generated by the microphone at a test frequency is greater than the power of the signal generated by the microphone for longer than a second response time, at every other test frequency, the second response time advantageously being greater than, e.g., approximately 750 ms.

In another example embodiment of the present invention, the adjustment or setting of the bandpass filter with respect to the test frequency is repeated, at the earliest, following a minimum response or dead time. The minimum response time may be, e.g., 200 ms to 300 ms.

In yet another example embodiment of the present invention, the bandpass filter is set to block the component of the signal generated by the microphone at a frequency range around the stop frequency when, following a repetition time, which is greater than the minimum response time, the power of the signal generated by the microphone at the test frequency is greater by more than an upper limiting value than the power of the signal generated by the microphone at the essentially first harmonic of the test frequency, and/or when the decision is made that the power of the signal generated by the microphone at the test frequency is increasing exponentially.

In yet another example embodiment of the present invention, the bandpass filter is set to block the component of the signal generated by the microphone at an expanded frequency range around the test frequency when, following a repetition time, which is greater than the minimum response time, the power of the signal generated by the microphone at the test frequency is greater by more than an upper limiting value than the power of the signal generated by the microphone at the essentially first harmonic of the test frequency, and/or when the decision is made that the power of the signal generated by the microphone at the test frequency is increasing exponentially.

In addition to the foregoing, to operate a voice-enhancement system, such as a communication and/or intercom/two-way intercom or duplex telephony device in a motor vehicle, using at least one microphone and at least one loudspeaker to reproduce a signal generated by the microphone, as well as a bandpass filter configured between the microphone and the loudspeaker, the power of the signal generated by the microphone is defined at at least three test frequencies, it being ascertained by evaluating the power of the signal generated by the microphone, at the test frequencies, whether feedback exists, and the bandpass filter being set to block a component of the signal generated by the microphone that exists around a stop frequency, when it is established that feedback exists.

Stop frequency in the context of the present invention may be the test frequency at which the power of the signal generated by the microphone is at its maximum. In an example embodiment of the present invention, however, the stop frequency is the test frequency, to which a correction frequency is added and at which the power of the signal generated by the microphone is at its maximum; i.e., a correction frequency is added to the test frequency at which the power of the signal generated by the microphone is at its maximum. This correction frequency may be formed as a function of the power of the signal generated by the microphone at the test frequency at which the power of the signal generated by the microphone is at its maximum, as well as a function of the power of the signal generated by the microphone at at least one test frequency existing, e.g., directly, next to this test frequency.

Thus, the correction frequency may be generated in accordance with:

$$fkorr=sign*fdist*Pmaxneigh/(Pmax+Pmaxneigh),$$ in which:

fkorr represents the correction frequency;

fdist represents the spacing between the test frequency at which the power of the signal generated by the microphone is at its maximum, and a test frequency having the greatest power, directly next to the test frequency at which the power of the signal generated by the microphone is at its maximum;

Pmax represents the power of the signal generated by the microphone at the test frequency at which the power of the signal generated by the microphone is at its maximum, (thus Pmax is the power at the test frequency which is greater than the power of every other test frequency);

Pmaxneigh represents the power of the signal generated by the microphone at which the test frequency having the greatest power, directly next to the test frequency at which the power of the signal generated by the microphone is at its maximum; and sign represents an algebraic sign;

sign being positive when the test frequency having the greatest power, directly next to the test frequency at which the power of the signal generated by the microphone is at its maximum, is greater than the test frequency at which the power of the signal generated by the microphone is at its maximum, sign otherwise being negative.

This is further described on the basis of the following example:

192 test frequencies $f_1, f_2, \ldots f_{192}$ are assumed. $f_1$ is equal to 40 Hz. fdist is 40 Hz for all test frequencies. In addition, for the powers of the signal generated by the microphone, it holds for the test frequencies $f_1, f_2, \ldots f_{192}$:

$$P(f_1, f_2, \ldots f_{94})=1$$

$$P(f_{95})=4$$

$$P(f_{96})=16$$

$$P(f_{97})=2$$

$$P(f_{98}, f_{99}, \ldots f_{192})=1$$

It then holds that:

$$fkorr=(-)*40\text{ Hz}*4(16+2)=-8\text{ Hz}$$

The test frequency at which the power of the signal generated by the microphone is at its maximum is, thus, 3840 Hz, and the stop frequency is 3832 Hz.

It may be provided that, at least in certain example embodiments, to generate the correction frequency in accordance with:

$$f\text{korr}=\Delta f*(P\text{neighright}-P\text{neighleft})/(P\text{max}+|P\text{neighright}-P\text{neighleft}|),\text{ wherein:}$$

fkorr represents the correction frequency;

Δf represents the spacing between two test frequencies;

Pmax represents the power of the signal generated by the microphone at the test frequency at which the power of the signal generated by the microphone is at its maximum;

Pneighright represents the power of the signal generated by the microphone at the test frequency directly above (thus to the "right" of) the test frequency at which the power of the signal generated by the microphone is at its maximum; and Pneighleft represents the power of the signal generated by the microphone at the test frequency directly below (thus to the "left" of) the test frequency at which the power of the signal generated by the microphone is at its maximum.

Using the above numerical example as a basis, it holds, therefore, in this case that:

$$f\text{korr}=40\text{ Hz}*(2-4)/(16+|4-2|)=-4.44\text{ Hz}$$

The test frequency at which the power of the signal generated by the microphone is at its maximum is, thus, 3840 Hz, and the stop frequency 3835.56 Hz.

In another example embodiment of the present invention, the spacings between at least some of the test frequencies, or all of the test frequencies, are equidistant.

In yet another example embodiment of the present invention, the existence of feedback may only be ascertained when the power of the signal generated by the microphone at the test frequency at which the power of the signal generated by the microphone is at a maximum, is greater by more than an upper limiting value than the power of the signal generated by the microphone at the first harmonic of this test frequency, the upper limiting value, e.g., being between 20 and 40 dB, for the most part, at, e.g., 30 dB.

In yet another example embodiment of the present invention, the non-existence of feedback is ascertained when the power of the signal generated by the microphone at the test frequency at which the power of the signal generated by the microphone is at a maximum, is greater by less than a lower limiting value than the power of the signal generated by the microphone at the first harmonic of this test frequency, the lower limiting value, e.g., being between 5 and 20 dB, for the most part, at, e.g., 12 dB.

In another example embodiment of the present invention, the existence of feedback is (only) ascertained when the power of the signal generated by the microphone at the test frequency at which the power of the signal generated by the microphone is at a maximum, is increasing, at least approximately, exponentially.

In another example embodiment of the present invention, the existence of feedback is (only) ascertained when the power of the signal generated by the microphone is greater, at at least one test frequency, than a response threshold for longer than a first response time. The first response time may be greater than, e.g., approximately 750 ms. The response threshold may be selected as a function of the power of signal S, i.e., of the sum of the power of all test frequencies.

In another example embodiment of the present invention, the existence of feedback is (only) ascertained when the power of the signal generated by the microphone is greater for longer than a first response time, at at least one test frequency, than the power of the signal generated by the microphone at every other test frequency. The second response time may be greater than, e.g., approximately 750 ms.

In another example embodiment of the present invention, the adjustment or setting of the bandpass filter is repeated, at the earliest, following a minimum response or dead time, which may be, e.g., between 100 ms and 300 ms.

In yet another example embodiment of the present invention, the power of the signal generated by the microphone is determined at at least 50, e.g., at 150 to 300 test frequencies.

In another example embodiment of the present invention, the bandpass filter is a notch filter or a filter bank or multifilter having at least one notch filter. The filter bank may include 10 notch filters, for example.

In accordance with an example embodiment of the present invention, a method for operating a voice-controlled system, such as a communication and/or an intercommunication device for a motor vehicle, including a microphone, a speaker connected to the microphone and a bandpass filter within a signal path between the microphone and the speaker, the bandpass filter including at least one adjustable parameter includes analyzing the frequency of a signal obtained by the microphone. The method also includes at least one of obtaining a comparison of the power at a certain frequency of the signal and the power of at least one harmonic of the certain frequency and obtaining a comparison of the power at a certain frequency of the signal and the power of the certain frequency at a later instant. The method further includes adjusting the at least one adjustable parameter dependent on the comparison.

Further aspects and details are set forth below in the following description of exemplary embodiments.

DETAILED DESCRIPTION

Figure 1:
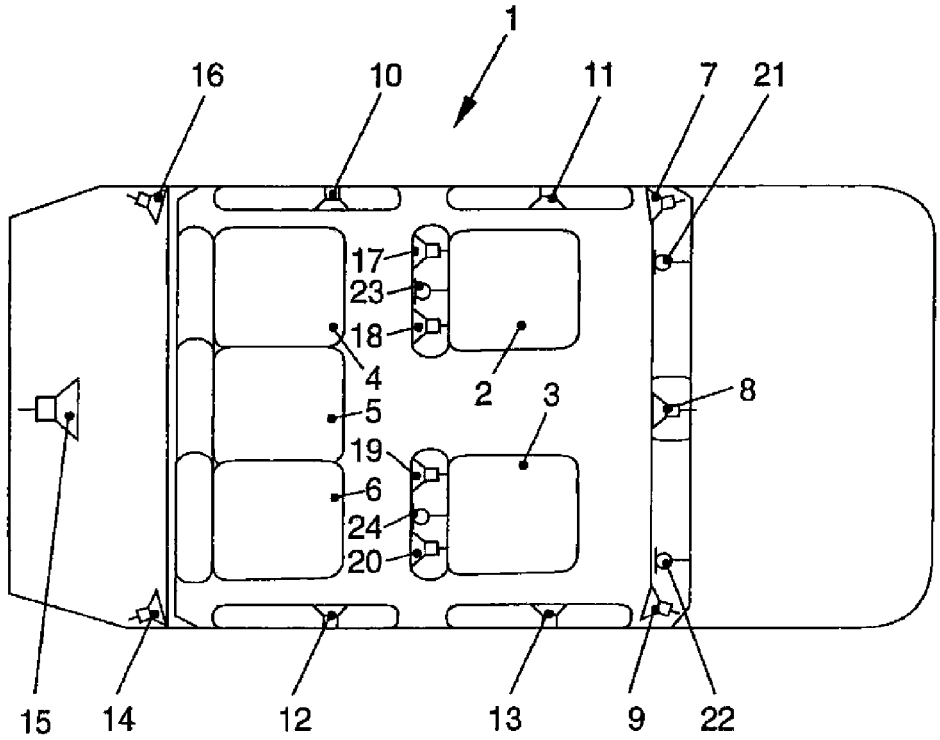
FIG. 1 is a schematic view of a motor vehicle.

FIG. 1 is an inside view of a motor vehicle 1 from above. In this context, reference numerals 2 and 3 indicate the front seats, and reference numerals 4, 5 and 6 indicate the rear seats of the motor vehicle. Reference numerals 7, 8, 9, 10, 11, 12, 13, 14, 15, 16, 17, 18, 19 and 20 indicate loudspeakers. Reference numerals 21, 22, 23 and 24 indicate microphones.

Loudspeakers 7, 8, 9, 10, 11, 12, 13, 14, 15, 16, 17, 18, 19 and 20 belong, in part, to a music system and, in part, to a communication and/or intercom/two-way intercom or duplex telephony device. They may also be used by both systems.

In the present exemplary embodiment, loudspeakers 9, 17, 18, 19, 20 output a signal generated by microphone 21. Loudspeakers 7, 17, 18, 19, 20 output a signal generated by microphone 22. Loudspeakers 7, 9, 19, 20 output a signal generated by microphone 23. Loudspeakers 7, 9, 17, 18 output a signal generated by microphone 24. In this manner, the possibility of effective verbal communication in a motor vehicle may be enhanced. In principle, the more strongly a signal is amplified between one of microphones 21, 22, 23, 24 and one of loudspeakers 7, 9, 17, 18, 19, 20, the more effective the communication is. However, the possibility of implementing such an amplification is limited by possible feedback effects caused by sound radiated by a loudspeaker 7, 9, 17, 18, 19, 20, which is received by a microphone 21, 22, 23, 24, and is subsequently amplified and radiated by loudspeaker 7, 9, 17, 18, 19, 20.

Figure 2:
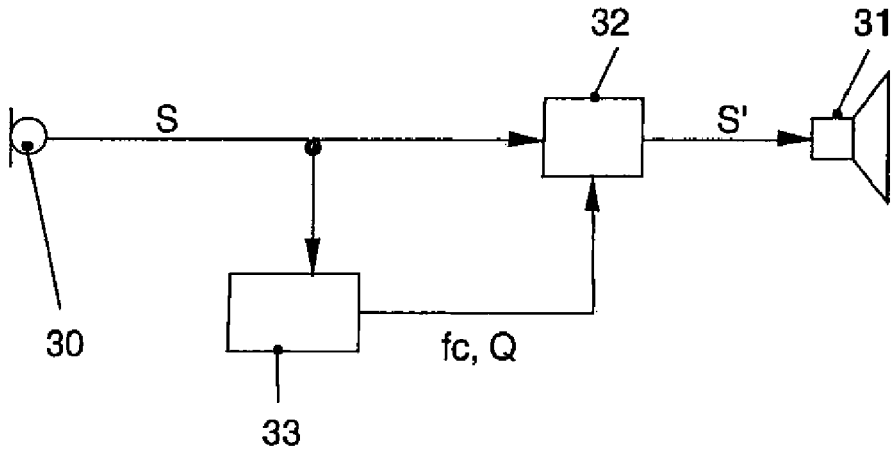
FIG. 2 is a schematic view of an exemplary embodiment of a device according to the present invention.

To reduce such a feedback, as illustrated in FIG. 2, a bandpass filter 32 is provided between a microphone 30, which may be one of microphones 21, 22, 23, 24, and a loudspeaker 31, which may be one of loudspeakers 7, 9, 17, 18, 19, 20. This filters a signal S generated by microphone 30 and supplies a filtered signal S', which has certain frequency ranges filtered out, for which a decision logic 33 had recognized the danger of feedback. To this end, decision logic 33 determines filter parameters $f_c$ and Q, which are used to adjust bandpass filter 32.

To amplify signal S and/or signal S', amplifiers may be provided. However, the amplifier function may also be provided by the bandpass filter.

Figure 3:
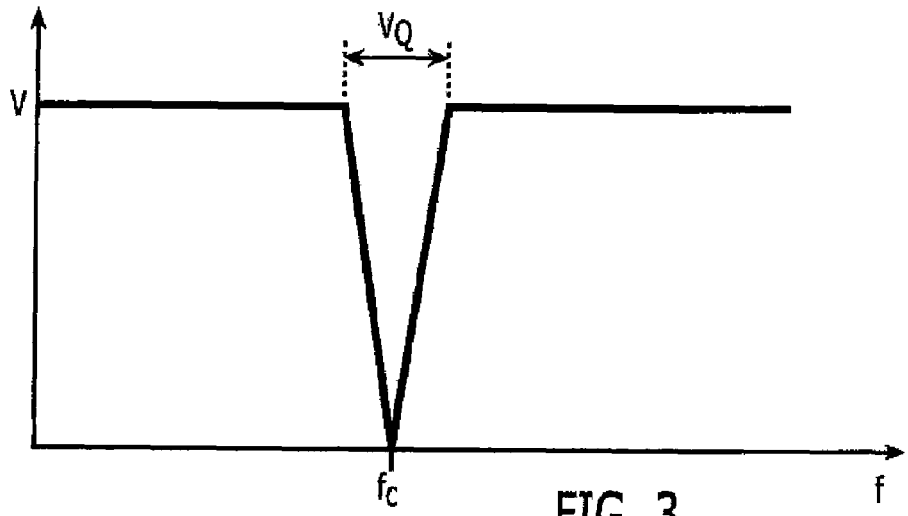
FIG. 3 is a schematic view of a notch filter.
Figure 4:
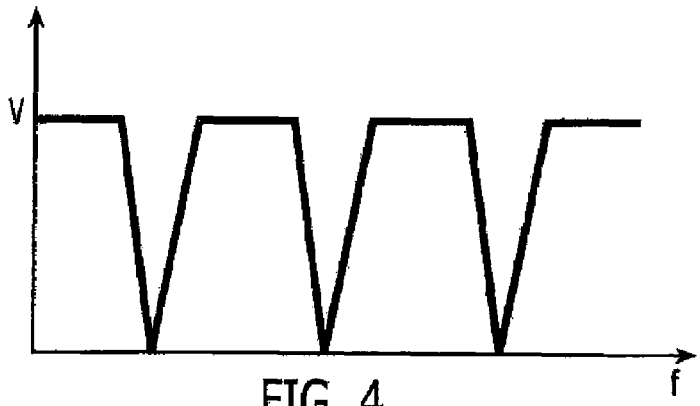
FIG. 4 is a schematic view of a filter bank.

FIG. 3 illustrates the characteristic curve of a bandpass filter arranged as a notch filter, amplification V of the bandpass filter being plotted over frequency f. In this context, $f_c$ indicates the mid-frequency of the bandpass filter and Q indicates its quality. To filter a plurality of frequency ranges, bandpass filter 32 may be arranged as a filter bank, as illustrated in FIG. 4. The filter bank may include up to 10 notch filters.

Figure 5:
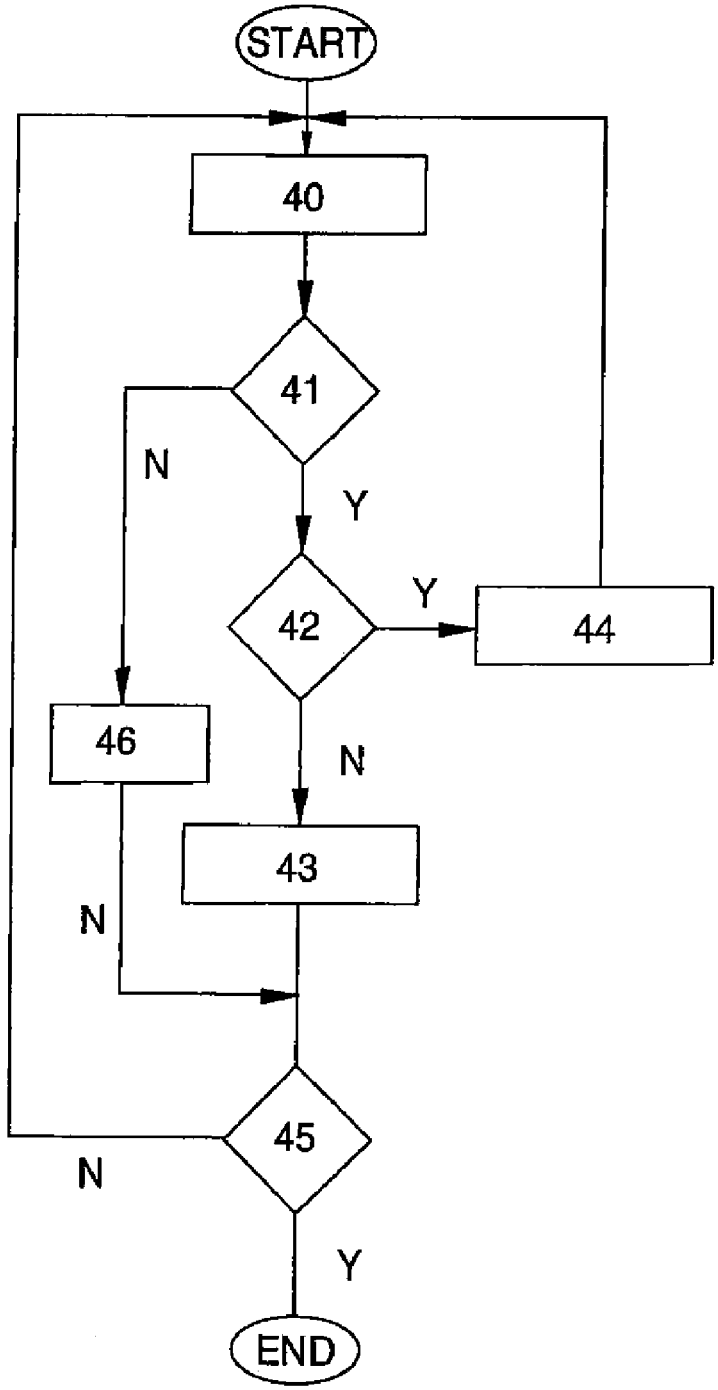
FIG. 5 illustrates an exemplary embodiment of a flow diagram implemented in a decision logic.

FIG. 5 illustrates an exemplary embodiment of a flow diagram implemented in a decision logic 33. In this context, a test frequency is first defined in a step 40. To this end, frequency f of signal S is analyzed, and, as illustrated exemplarily in FIG. 6, power P of signal S is determined at, e.g., 192, various test frequencies $f_n$, $f_{n+1}$, $f_{n+2}$, $f_{n+3}$, $f_{n+4}$, $f_{n+5}$, $f_{n+6}$, $f_{n+7}$, $f_{n+8}$, which are spaced apart by, e.g., 40 Hz. For test frequency $f_{n+5}$, at which the power is at its maximum, the following sequence is executed. However, it is also possible for the following sequence to be executed for more than one test frequency.

It may be provided to average the power over time at test frequencies $f_n$, $f_{n+1}$, $f_{n+2}$, $f_{n+3}$, $f_{n+4}$, $f_{n+5}$, $f_{n+6}$, $f_{n+7}$, $f_{n+8}$, i.e. to form an average value over time, and to analyze this time average of the power instead of the current or active-power of signal S at test frequencies $f_n$, $f_{n+1}$, $f_{n+2}$, $f_{n+3}F_{n+4}$, $f_{n+5}$, $f_{n+6}$, $f_{n+7}$, $f_{n+8}$. To the extent that the power of signal S is mentioned herein, it may also include the average value of the power formed over a certain time period. In addition, the concept of power in accordance with the present invention, may also include amplitude or its time average. Also to be included in accordance with the present invention are other variations of the power, of the amplitude, or of their time averages, such as normalized quantities, etc. Thus, for instance, in the context of the present invention, the power of signal S at a test frequency $f_n$, may be understood as the value of the power of signal S at this test frequency $f_n$, divided by the sum of the power of signal S at all test frequencies $f_n$, $f_{n+1}$, $f_{n+2}$, $f_{n+3}$, $f_{n+4}$, $f_{n+5}$, $f_{n+6}$, $f_{n+7}$, $f_{n+8}$.

Step 40 is followed by query 41, which checks if there is a danger of feedback. Details pertaining to this query are explained with reference to FIGS. 7 and 10. If there is a danger of feedback, query 41 is followed by a query 42, as to whether signal S generated by microphone 30 has already been reduced by the bandpass filter by signal components around the test frequency.

If signal S generated by microphone 30 is not already reduced by the bandpass filter, by signal components around the test frequency, then query 42 is followed by a step 43, in which the filter parameters, i.e., mid-frequency $f_c$ and quality Q of the bandpass filter, are generated. Mid-frequency $f_c$ is an example of the stop frequency along the lines of the claims. The stop frequency may also be, in particular, the frequency range around mid-frequency $f_c$, which the bandpass filter actually filters out from signal S produced by microphone 30.

In the process, mid-frequency $f_c$ may be equated with the test frequency. In an example embodiment of the present invention, however, mid-frequency $f_c$ is the test frequency, to which a correction frequency is added and at which the power of the signal generated by the microphone is at its maximum; i.e., a correction frequency is added to the test frequency at which the power of the signal generated by the microphone is at its maximum. This correction frequency may be formed as a function of the power of the signal generated by the microphone at the test frequency at which the power of the signal generated by the microphone is at its maximum, as well as a function of the power of the signal generated by the microphone at at least one test frequency existing next to this test frequency. Thus, the correction frequency may be generated in accordance with:

$$fkorr=sign*fdist*Pmaxneigh/(Pmax+Pmaxneigh),$$ in which:

fkorr represents the correction frequency;

fdist represents the spacing between the test frequency at which the power of the signal generated by the microphone is at its maximum, and a test frequency having the greatest power, directly next to the test frequency at which the power of the signal generated by the microphone is at its maximum;

Pmax represents the power of the signal generated by the microphone at the test frequency at which the power of the signal generated by the microphone is at its maximum;

Pmaxneigh represents the power of the signal generated by the microphone at which the test frequency having the greatest power, directly next to the test frequency at which the power of the signal generated by the microphone is at its maximum; and sign represents an algebraic sign;

sign being positive when the test frequency having the greatest power, directly next to the test frequency at which the power of the signal generated by the microphone is at its maximum, is greater than the test frequency at which the power of the signal generated by the microphone is at its maximum, sign otherwise being negative.

In the present exemplary embodiment, the correction frequency is formed in accordance with:

$$fkorr=\Delta f*(Pneighright-Pneighleft)/(Pmax+|Pneighright-Pneighleft|),$$ in which:

fkorr represents the correction frequency;

Δf being the spacing between two test frequencies;

Pmax represents the power of the signal generated by the microphone at the test frequency at which the power of the signal generated by the microphone is at its maximum;

Pneighright represents the power of the signal generated by the microphone at the test frequency directly above the test frequency at which the power of the signal generated by the microphone is at its maximum; and Pneighleft represents the power of the signal generated by the microphone at the test frequency directly below the test frequency at which the power of the signal generated by the microphone is at its maximum.

Quality Q is adjusted to a predefined value of, for example, 1/40 Hz.

Step 43 is followed by query 45, as to whether the program is to be terminated. If the program is not to be terminated, then query 45 is followed by step 40. Otherwise, the program is ended.

If signal S generated by microphone 30 is already reduced by the bandpass filter, by signal components around the test frequency, then query 43 is followed by a step 44 in which quality Q is reduced. In this manner, the bandpass filter is adjusted so that it blocks the component of the signal generated by the microphone at an expanded frequency range around mid-frequency $f_c$. Step 44 is followed by step 40.

Provided that there is no danger of feedback, query 41 is followed by query 45 or optionally by a step 46 in which the filtering of signal S generated by microphone 30, around the test frequency, is ended.

An example embodiment of the present invention provides for query 41 to be repeated, at the earliest following a minimum response or dead time, in the present exemplary embodiment, the minimum response time being, e.g., 200 ms to 300 ms.

Figure 7:
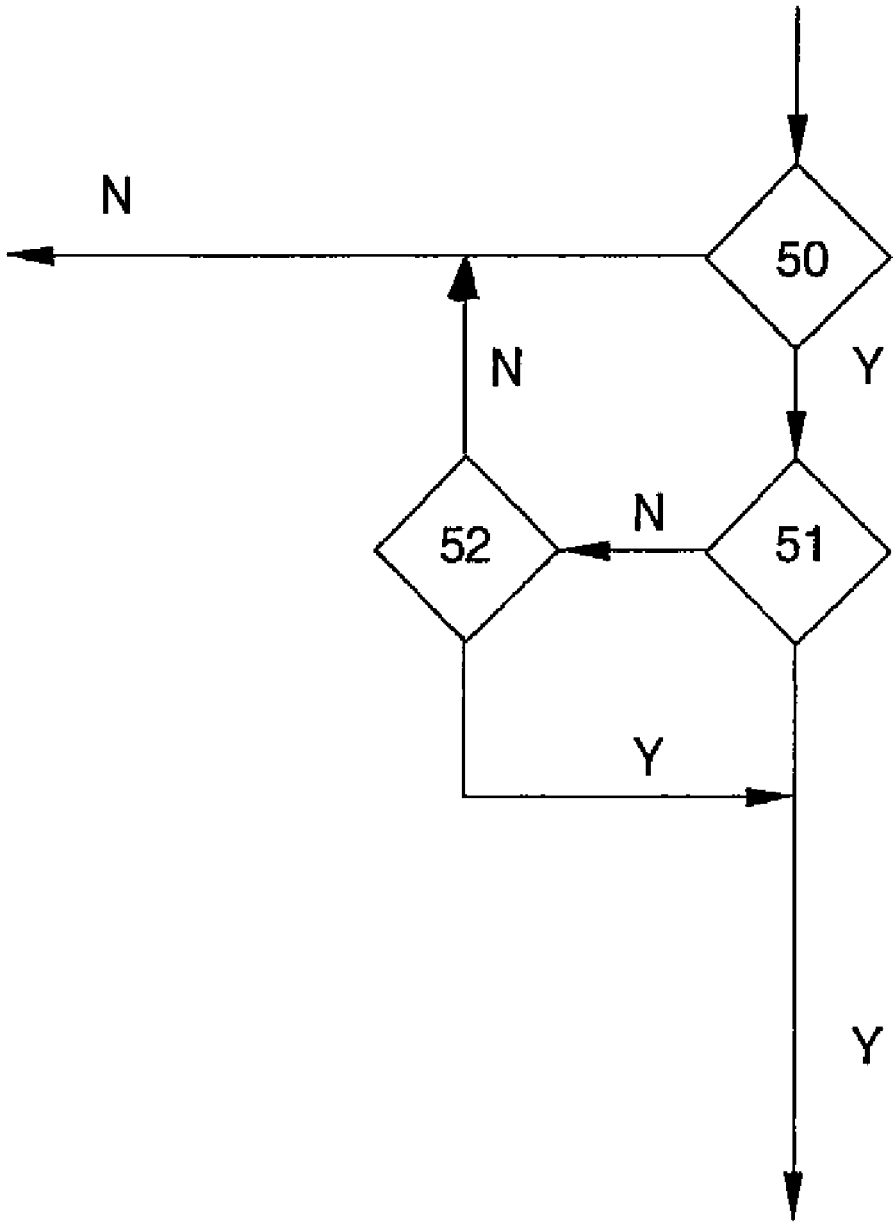
FIG. 7 illustrates an exemplary embodiment of query 41 illustrated in FIG. 5.

FIG. 7 illustrates an exemplary embodiment of query 41. Next, a query 50 checks whether the power of signal S generated by microphone 30 at the test frequency is greater, by not less than a lower limiting value Δ1, than the power of signal S generated by microphone 30, at the first harmonic (thus twice) the test frequency. Lower limiting value Δ1 is between 5 and 20 dB, for example. The lower limiting value Δ1 may amount for the most part to, e.g., 12 dB. This query is illustrated, by example, in FIG. 8, $f_{H0}$ indicating the test frequency, $f_{H1}$, $f_{H2}$, $f_{H3}$ and $f_{H4}$ indicating the first, second, third, and fourth harmonic of the test frequency, and $f_{H1/2}$ indicating the first subharmonic of the test frequency. P indicates the power at a frequency f. Query 50 thus checks whether:

$$P(f_{H0})-P(f_{H1})\geqq\Delta 1$$

Provision may optionally be made, to supplement query 50 by one or more of the queries:

$$P(f_{H0})-P(f_{H1/2})\geqq\Delta 1$$

$$P(f_{H0})-P(f_{H2})\geqq\Delta 1$$

$$P(f_{H0})-P(f_{H3})\geqq\Delta 1$$

$$P(f_{H0})-P(f_{H4})\geqq\Delta 1$$

it being possible, as the case may be, for other limiting values to be selected, as well.

Figure 6:
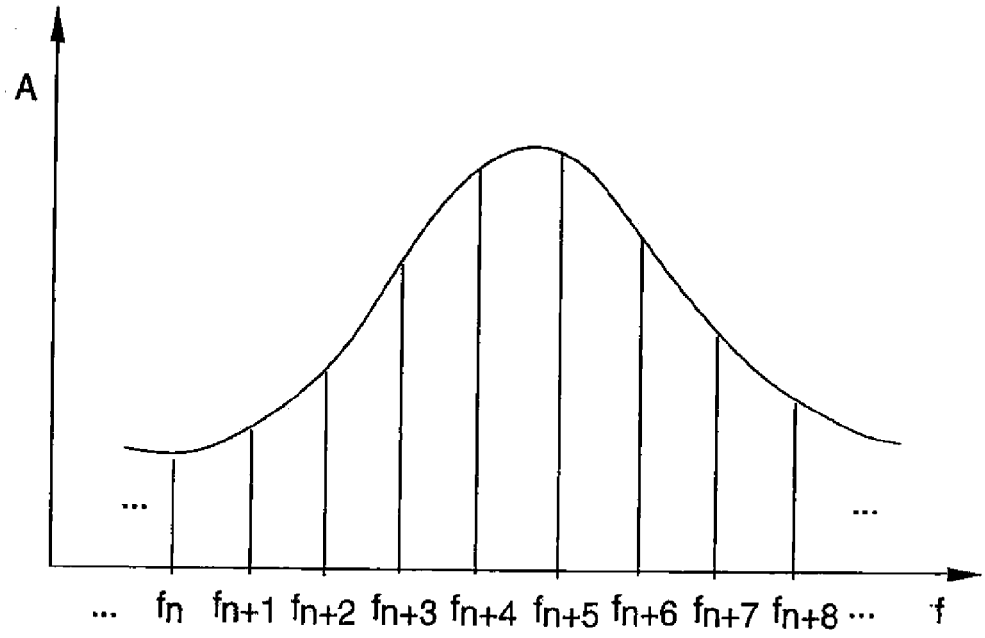
FIG. 6 is a power-frequency diagram.
Figure 8:
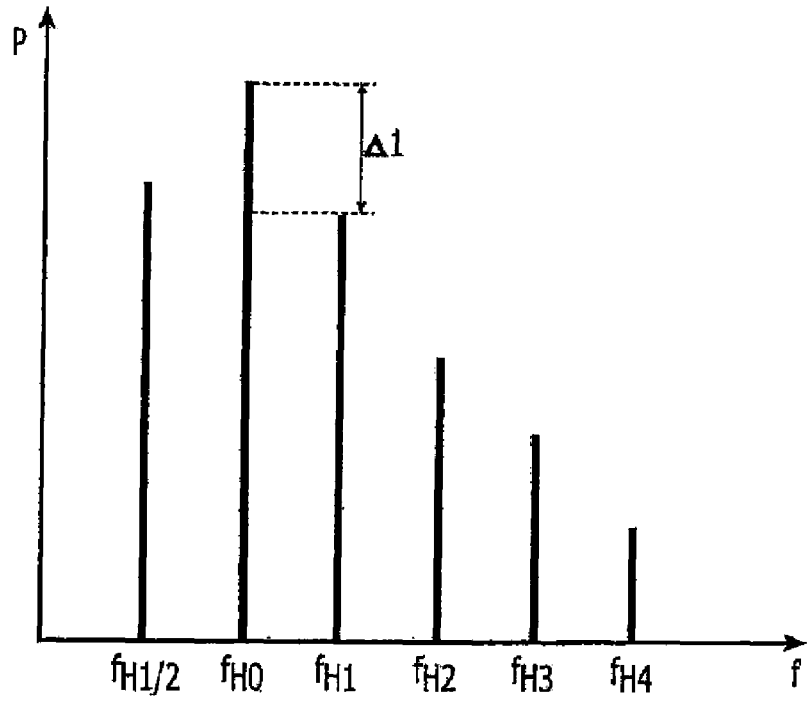
FIG. 8 is a power-frequency diagram.
Figure 9:
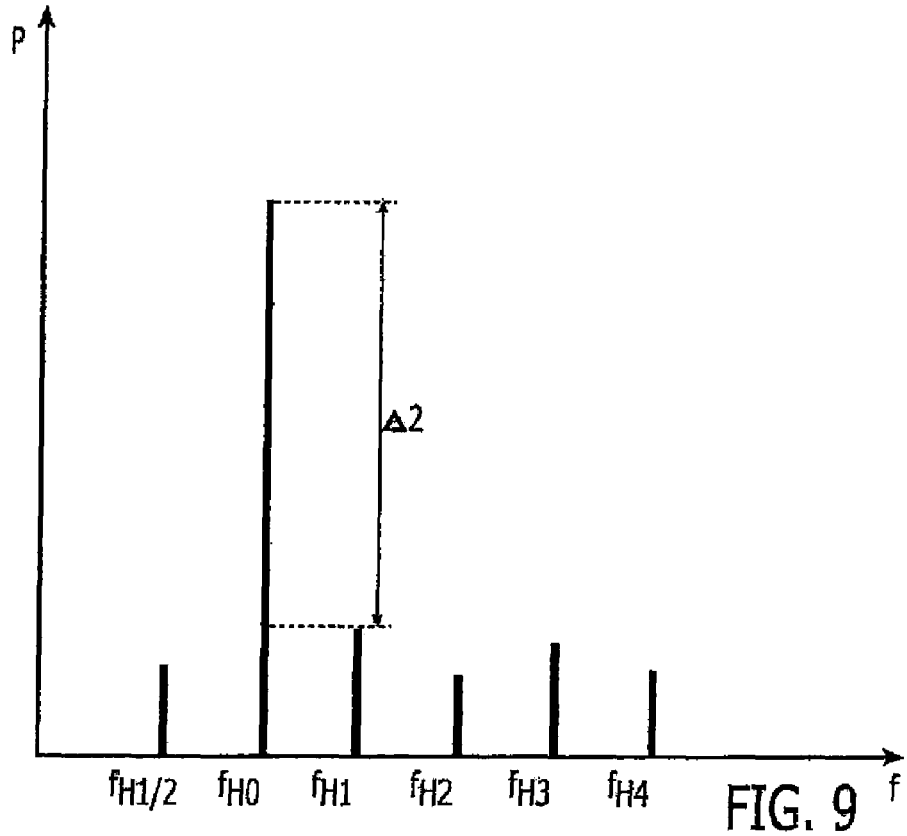
FIG. 9 is a power-frequency diagram.

Test frequencies $f_n$, $f_{n+1}$, $f_{n+2}$, $f_{n+3}$, $f_{n+4}$, $f_{n+5}$, $f_{n+6}$, $f_{n+7}$, $f_{n+8}$ illustrated in FIG. 6 are to be distinguished from the subharmonics/harmonics $f_{H1/2}$, $f_{H1}$, $f_{H2}$, $f_{H3}$ and $f_{H4}$ illustrated in FIGS. 8 and 9, respectively. If, for instance, 192 test frequencies $f_1$, $f_2$, . . . $f_{192}$ are assumed, which are spaced apart by 40 Hz, $f_1$ being equal to 40 Hz, and if $f_{44}=f_{H0}$, thus the test frequency at which the power of signal S generated by microphone 30 is at its maximum, then $f_{H1}=f_{88}$ and $f_{H2}=f_{122}$.

If the power of signal S generated by microphone 30 at the test frequency is greater, by not less than a lower limiting value Δ1, than the power of signal S generated by microphone 30 at the first harmonic of the test frequency, then query 50 is followed by a query 51. Query 51 checks whether the power of signal S generated by microphone 30 at the test frequency is greater, by not less than an upper limiting value Δ2, than the power of signal S generated by microphone 30, at the first harmonic of the test frequency. Upper limiting value Δ2 is between 20 and 40 dB, for example. Upper limiting value Δ2 may amount to, e.g., approximately 30 dB. This query is illustrated, by example, in FIG. 9, $f_{H0}$ indicating test frequency, $f_{H1}$, $f_{H2}$, $f_{H3}$ and $f_{H4}$ indicating the first, second, third, and fourth harmonic of the test frequency, and $f_{H1/2}$ indicating the first subharmonic of the test frequency. P indicates the power at a frequency f. Query 51 thus checks whether:

$$P(f_{H0})-P(f_{H1})\geqq\Delta 2$$

Provision may optionally be made, to supplement query 51 by one or more of the queries:

$$P(f_{H0})-P(f_{H1/2})\geqq\Delta 2$$

$$P(f_{H0})-P(f_{H2})\geqq\Delta 2$$

$$P(f_{H0})-P(f_{H3})\geqq\Delta 2$$

$$P(f_{H0})-P(f_{H4})\geqq\Delta 2$$

it being possible, as the case may be, for other limiting values to be selected, as well.

If the power of signal S generated by microphone 30 at the test frequency is greater, by not more than an upper limiting value Δ2, than the power of signal S generated by microphone 30 at the first harmonic of the test frequency, then query 51 is followed by a query 52, which, by comparing the power of signal S generated by microphone 30 at the test frequency, to the power of signal S generated by microphone 30 at the test frequency at at least an earlier point in time, checks whether the power of the signal generated by the microphone is increasing exponentially at the test frequency.

Figure 10:
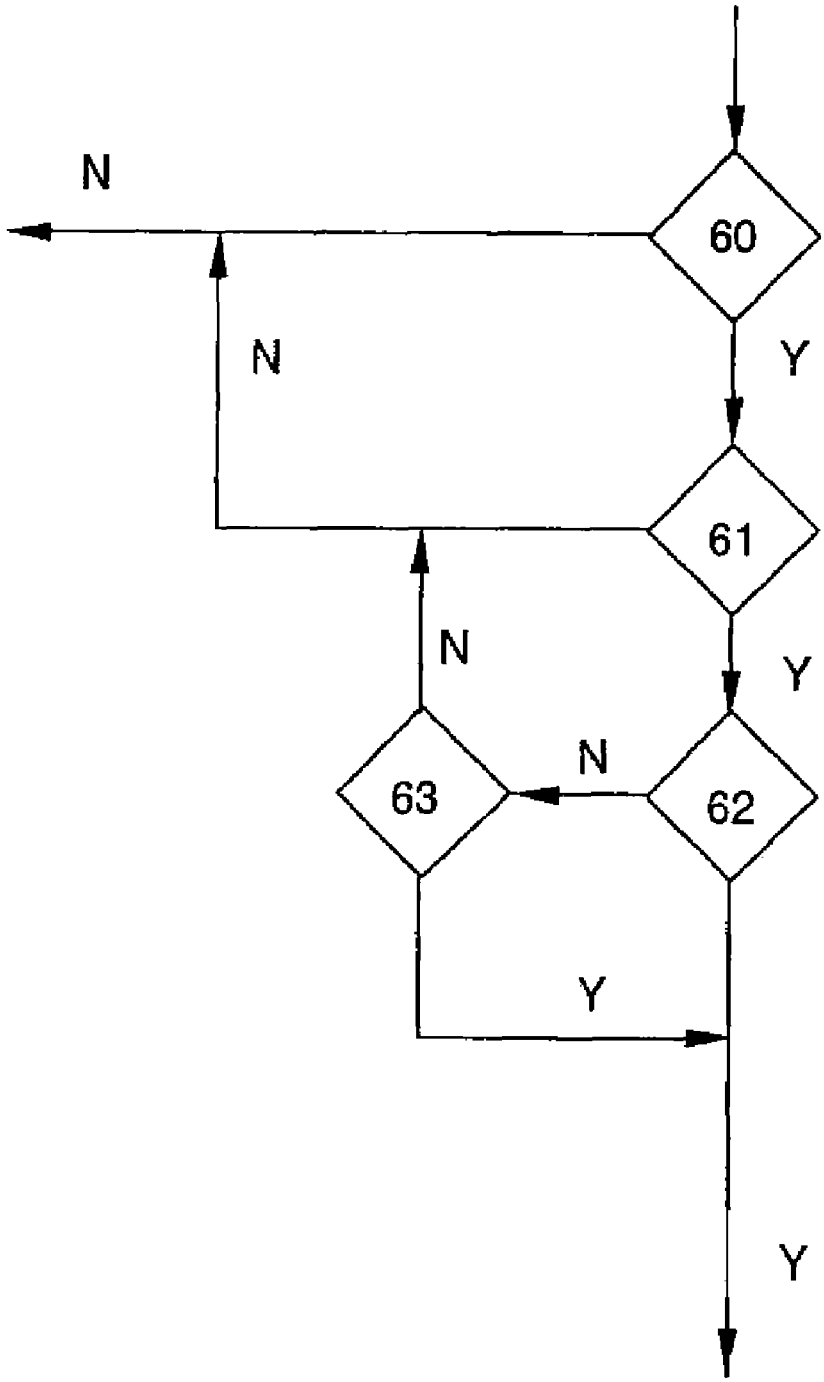
FIG. 10 illustrates another exemplary embodiment of query 41 illustrated in FIG. 5.

FIG. 10 illustrates another exemplary embodiment of query 41. Next, a query 60 checks whether the power of signal S generated by microphone 30 is greater at the test frequency than a predefined limiting value. In this case, a query 61 follows which corresponds to query 50. Queries 62 and 63 correspond to queries 51 and 52.

Figure 11:
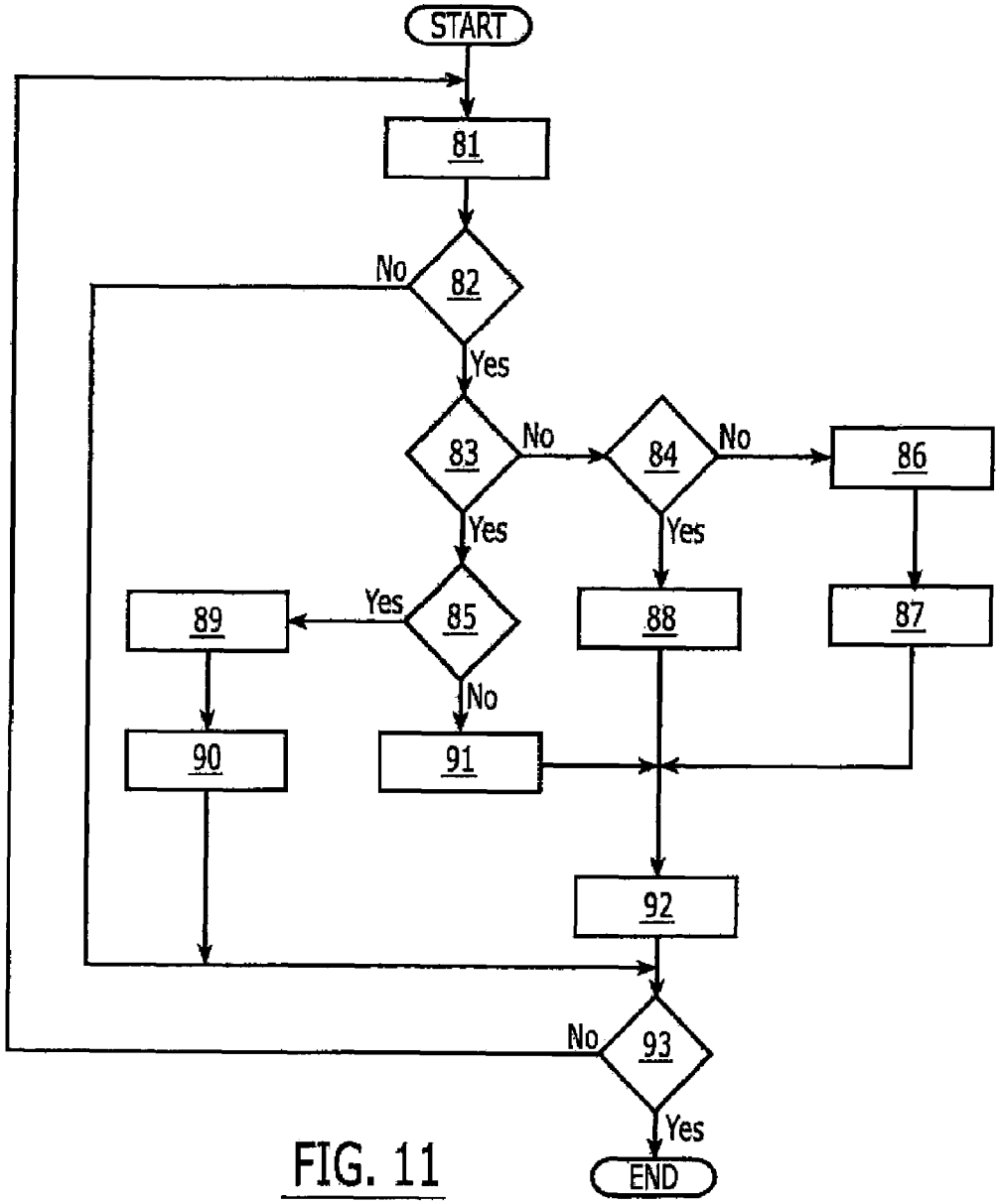
FIG. 11 illustrates a further exemplary embodiment of a flow diagram implemented in a decision logic.
Figure 12:
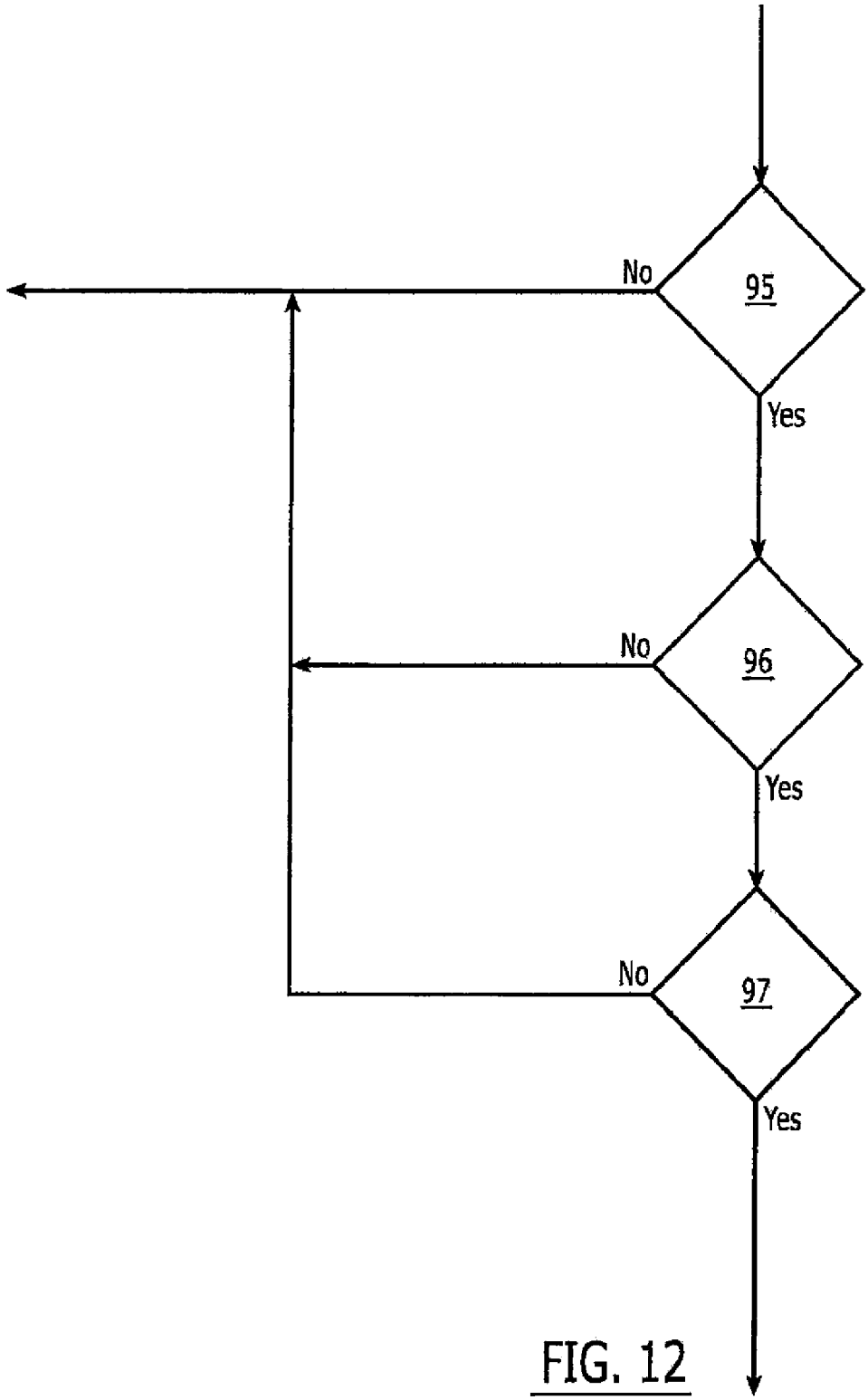
FIG. 12 illustrates an exemplary embodiment of queries 41 and 82.

FIG. 11 illustrates an exemplary embodiment of a flow diagram implemented in decision logic 33. The functional sequence begins with a step 81, which corresponds to step 40 illustrated in FIG. 5. Step 81 is followed by a query 82, which corresponds to query 41 illustrated in FIG. 5 and which checks if there is a danger of feedback. FIGS. 7 and 10 illustrate exemplary embodiments of query 82. In connection with the exemplary embodiment illustrated in FIG. 11, it may be provided to implement a feedback detection (query 82), as indicated in FIG. 12.

Provided that there is no danger of feedback or that feedback is not ascertained, query 82 is followed by a query 83 corresponding to query 45 as to whether the program is to be terminated. If the program is not to be terminated, then query 93 is followed by step 81. Otherwise, the program is ended.

If there is a danger of feedback, query 82 is followed by a query 83 corresponding to 42, as to whether signal S generated by microphone 30 has already been reduced by the bandpass filter by signal components around the test frequency. If signal S generated by microphone 30 is already reduced by the bandpass filter, by signal components around the test frequency, then query 83 is followed by a query 85, or alternatively by a query 84.

Query 84 queries as to whether a notch filter is available. If a notch filter is available, query 84 is followed by a step 88, which corresponds to step 43 and in which filter parameters, i.e., for the exemplary embodiment, mid-frequency $f_c$ and quality Q of the bandpass filter, are produced. If, on the other hand, query 84 reveals that no notch filter is available, then query 84 is followed by a step 86 in which the power of signal S is reduced by a reduction factor, which may be between, e.g., 2 dB and 5 dB, for the most part, e.g., at 3 dB. Step 86 is followed by a step 87 in which the entire cycle is halted for a pause time of, e.g., approximately 3 s. However, this step may be executed only once per cycle.

Query 85 checks whether a further expansion of the frequency range in which the bandpass filter is blocking, thus a further reduction in its quality Q, would provide that a predefined minimal quality may not be attained. If further expanding the frequency range provides that a predefined minimal quality may not be attained, then query 85 is followed by a step 89, or alternatively by a step 91. In step 91 which corresponds to step 44, quality Q is reduced.

Steps 87, 88 and 91 are followed by a step 92 in which the sequence is paused for a minimum response or dead time, the minimum response or dead time in the present exemplary embodiment being, e.g., 100 ms.

In step 89, the power of signal S is reduced by a reduction factor, which may be between, e.g., 2 dB and 5 dB, for the most part, e.g., at 3 dB. Step 89 is followed by a step 90 in which the entire cycle is halted for a pause time of, e.g., approximately 3 s.

FIG. 7 illustrates an exemplary embodiment of query 82, in accordance with which query 41 may also be implemented. In this context, a query 95 first checks whether the power of signal S generated by microphone 30 at the test frequency is greater, for longer than 750 ms, than the power of signal S generated by microphone 30, at every other test frequency. If the power of signal S generated by microphone 30 at the test frequency is greater, for longer than 750 ms, than the power of signal S generated by microphone 30, at every other test frequency, then query 95 is followed by a query 96. Otherwise, query 95 is followed by query 93.

Query 96 checks whether the power of signal S generated by microphone 30 at the test frequency is greater, by not less than 12 dB, than the power of signal S generated by microphone 30, at the first harmonic of (thus twice) the test frequency. If the power of signal S generated by microphone 30 at the test frequency is greater, by not less than 12 dB, than the power of signal S generated by microphone 30 at the first harmonic of the test frequency, then query 96 is followed by a query 97. Otherwise, query 96 is followed by query 93.

A query 97 checks whether the power of signal S generated by microphone 30 is greater at the test frequency, for longer than 750 ms, than a response threshold. If the power of signal S generated by microphone 30 is greater at the test frequency, for longer than 750 ms, than a response threshold, then query 97 is followed by query 83. Otherwise, query 95 is followed by query 93.

The feedback detection in accordance with the present invention is not limited to the example embodiments illustrated in FIGS. 7, 10, and 12. Provision may be made, for example, for queries 52 and 63 to follow the "no" outputs of queries 50 and 61, respectively. In addition, the binary decision logic of the example embodiments illustrated in FIGS. 7, 10, and 12 may be replaced with a fuzzy decision logic, thus fuzzy logic or neural networks.

LIST OF REFERENCE CHARACTERS

| | |
|---|---|
| 1 | motor vehicle |
| 2, 3 | front seats |
| 4, 5, 6 | rear seats |
| 7, 8, 9, 10, 11, 12, 13, 14, 15, 16, 17, 18, 19, 20, 31 | loudspeakers |
| 21, 22, 23, 24, 30 | microphones |
| 32 | bandpass filter |
| 33 | decision logic |
| 40, 41, 43, 44, 46, 81, 84, 86, 87, 88, 89, 90 91, 92 | steps |
| 41, 42, 45, 50, 51, 52, 60, 61, 62, 63, 82, 83, 84, 85, 93, 95, 96, 97 | queries |
| f | frequency |
| $f_{H0}$ | test frequency |
| $f_{H1}$ | first harmonic of the test frequency |
| $f_{H2}$ | second harmonic of the test frequency |
| $f_{H3}$ | third harmonic of the test frequency |
| $f_{H4}$ | fourth harmonic of the test frequency |
| $f_{H1/2}$ | first subharmonic of the test frequency |
| $f_n$, $f_{n+1}$, $f_{n+2}$, $f_{n+3}$, $f_{n+4}$, $f_{n+5}$, $f_{n+6}$, $f_{n+7}$, $f_{n+8}$, $f_1$, $f_2$, $f_{44}$, $f_{88}$, $f_{94}$, $f_{95}$, $f_{97}$, $f_{98}$, $f_{122}$, $f_{192}$ | frequency points |
| fc | mid-frequency |
| fdist | the spacing between the test frequency at which the power of the signal generated by the microphone is at its maximum, and a test frequency having the greatest power, directly next to the test frequency at which the power of the signal generated by the microphone is at its maximum |
| fkorr | correction frequency |
| Q | quality |
| P | power |
| Pmax | the power of the signal generated by the microphone at the test frequency at which the power of the signal generated by the microphone is at its maximum |
| Pmaxneigh | the power of the signal generated by the microphone at which the test frequency having the greatest power, directly next to the test frequency at which the power of the signal generated by the microphone is at its maximum |
| Pneighleft | the power of the signal generated by the microphone at the test frequency directly below the test frequency at which the power of the signal generated by the microphone is at its maximum |
| Pneighright | the power of the signal generated by the microphone at the test frequency directly above the test frequency at which the power of the signal generated by the microphone is at its maximum |
| S | signal |
| S' | filtered signal |
| sign | algebraic sign |
| V | amplification |
| Δ1 | lower limiting value |
| Δ2 | upper limiting value |
| Δf | spacing between two test frequencies |

What is claimed is:

1. A method for operating a voice-enhancement system including at least one microphone, at least one loudspeaker configured to reproduce a signal generated by the microphone and a bandpass filter configured between the microphone and the loudspeaker, comprising:

adjusting the bandpass filter at least one of as a function of a comparison between a power of the signal generated by the microphone at a test frequency and a power of the signal generated by the microphone at an at least substantially integral multiple of the test frequency and as a function of a comparison between the power of the signal generated by the microphone at the test frequency and a power of the signal generated by the microphone at the test frequency at at least an earlier point in time.

2. The method according to claim 1, wherein the voice-enhancement system includes at least one of a communication device, an intercom device, a two-way intercom device and a duplex telephony device arranged in a motor vehicle.

3. The method according to claim 1, wherein the bandpass filter is adjusted in the adjusting step as a function of the comparison between the power of the signal generated by the microphone at the test frequency and the power of the signal generated by the microphone at the at least substantially integral multiple of the test frequency and as a function of the comparison between the power of the signal generated by the microphone at the test frequency and the power of the signal generated by the microphone at the test frequency at at least the earlier point in time.

4. The method according to claim 1, further comprising setting the bandpass filter to block a component of the signal generated by the microphone at a stop frequency when the power of the signal generated by the microphone at the test frequency is greater by more than an upper limiting value than the power of the signal generated by the microphone at a first harmonic of the test frequency.

5. The method according to claim 4, wherein the upper limiting value is between 20 dB and 40 dB.

6. The method according to claim 5, wherein the upper limiting value is approximately 30 dB.

7. The method according to claim 1, further comprising setting the bandpass filter to not block a component of the signal generated by the microphone in accordance with a stop frequency when the power of the signal generated by the microphone at the test frequency is greater by less than a lower limiting value than the power of the signal generated by the microphone at a first harmonic of the test frequency.

8. The method according to claim 7, wherein the lower limiting value is between 5 dB and 20 dB.

9. The method according to claim 8, wherein the lower limiting value is approximately 12 dB.

10. The method according to claim 1, further comprising determining whether the power of the signal generated by the microphone at the test frequency is increasing exponentially in accordance with a comparison of the power of the signal generated by the microphone at the test frequency with the power of the signal generated by the microphone at the test frequency at at least earlier points in time.

11. The method according to claim 10, further comprising Setting the bandpass filter to block a component of the signal generated by the microphone in accordance with a stop frequency in accordance with determining in the determining step that the power of the signal generated by the microphone at the test frequency is increasing exponentially.

12. The method according to claim 1, further comprising setting the bandpass filter to block a component of the signal generated by the microphone in accordance with a stop frequency only when the power of the signal generated by the microphone at the test frequency is greater than a response threshold for longer than a first response time.

13. The method according to claim 12, wherein the first response time is greater than approximately 750 ms.

14. The method according to claim 1, further comprising: determining the power at more than one test frequency; and setting the bandpass filter to block a component of the signal generated by the microphone in accordance with a stop frequency only when the power of the signal generated by the microphone at one of the test frequencies is greater than the power of the signal generated by the microphone for longer than a second response time at every other test frequency.

15. The method according to claim 14, wherein the second response time is greater than approximately 750 ms.

16. The method according to claim 1, further comprising repeating the adjusting of the bandpass filter at the earliest following a minimum response time.

17. The method according to claim 16, wherein the minimum response time is between 100 ms and 300 ms.

18. The method according to claim 16, further comprising setting the bandpass filter to block a component of the signal generated by the microphone at a frequency range around a stop frequency at least one of when, following a repetition time that is greater than the minimum response time, the power of the signal generated by the microphone at the test frequency is greater by more than an upper limiting value than the power of the signal generated by the microphone at a first harmonic of the test frequency and when a decision is made that the power of the signal generated by the microphone at the test frequency is increasing exponentially.

19. The method according to claim 16, further comprising setting the bandpass filter to block a component of the signal generated by the microphone at an expanded frequency range around a stop frequency at least one of when, following a repetition time that is greater than the minimum response time, the power of the signal generated by the microphone at the test frequency is greater by more than an upper limiting value than the power of the signal generated by the microphone at a first harmonic of the test frequency and when a decision is made that the power of the signal generated by the microphone at the test frequency is increasing exponentially.

20. The method according to claim 19, wherein the frequency range around the stop frequency is expanded only up to a minimum quality.

21. The method according to claim 20, further comprising interrupting the signal generated by the microphone for an interruption period when the frequency range around the stop frequency is expanded up to the minimum quality.

22. The method according to claim 21, wherein the interruption period is greater than approximately 1 s to 5 s.

23. The method according to claim 22, wherein the interruption period is greater than approximately 3 s.

24. The method according to claim 4, wherein the stop frequency corresponds to a test frequency at which the power of the signal generated by the microphone is at a maximum.

25. The method according to claim 4, wherein the stop frequency corresponds to a test frequency to which a correction frequency is added and at which the power of the signal generated by the microphone is at a maximum.

26. The method according to claim 25, further comprising generating the correction frequency as a function of the power of the signal generated by the microphone at the test frequency at which the power of the signal generated by the microphone is at the maximum and as a function of the power of the signal generated by the microphone at at least one test frequency next to the test frequency at which the power of the signal generated by the microphone is at the maximum.

27. A method for operating a voice-enhancement system including at least one microphone, at least one loudspeaker configured to reproduce a signal generated by the microphone and a bandpass filter configured between the microphone and the loudspeaker, comprising:

adjusting the bandpass filter at least one of as a function of a comparison between a power of the signal generated by the microphone at a test frequency and a power of the signal generated by the microphone at an at least substantially integral multiple of the test frequency and as a function of a comparison between the power of the signal generated by the microphone at the test frequency and a power of the signal generated by the microphone at the test frequency at at least an earlier point in time;

setting the bandpass filter to block a component of the signal generated by the microphone at a stop frequency when the power of the signal generated by the microphone at the test frequency is greater by more than an upper limiting value than the power of the signal generated by the microphone at a first harmonic of the test frequency, the stop frequency corresponding to a test frequency to which a correction frequency is added and at which the power of the signal generated by the microphone is at a maximum; and;

generating the correction frequency as a function of the power of the signal generated by the microphone at the test frequency at which the power of the signal generated by the microphone is at the maximum and as a function of the power of the signal generated by the microphone at at least one test frequency next to the test frequency at which the power of the signal generated by the microphone is at the maximum;

wherein the correction frequency is generated in the correction frequency generating step in accordance with:

$$fkorr=sign*fdist*Pmaxneigh/(Pmax+Pmaxneigh),$$

wherein:

fkorr represents the correction frequency;

fdist represents a spacing between the test frequency at which the power of the signal generated by the microphone is at the maximum and a test frequency having a greatest power directly next to the test frequency at which the power of the signal generated by the microphone is at the maximum;

Pmax represents the power of the signal generated by the microphone at the test frequency at which the power of the signal generated by the microphone is at the maximum;

Pmaxneigh represents the power of the signal generated by the microphone at which the test frequency having the greatest power directly next to the test frequency at which the power of the signal generated by the microphone is at the maximum; and sign represents an algebraic sign; and wherein sign is positive when the test frequency having the greatest power directly next to the test frequency at which the power of the signal generated by the microphone is at the maximum is greater than the test frequency at which the power of the signal generated by the microphone is at the maximum, sign otherwise negative.

28. A method for operating a voice-enhancement system including at least one microphone. at least one loudspeaker configured to reproduce a signal generated by the microphone and a bandpass filter configured between the microphone and the loudspeaker, comprising:

adjusting the bandpass filter at least one of as a function of a comparison between a power of the signal generated by the microphone at a test frequency and a power of the signal generated by the microphone at an at least substantially integral multiple of the test frequency and as a function of a comparison between the power of the signal generated by the microphone at the test frequency and a power of the signal generated by the microphone at the test frequency at at least an earlier point in time;

setting the bandpass filter to block a component of the signal generated by the microphone at a stop frequency when the power of the signal generated by the microphone at the test frequency is greater by more than an upper limiting value than the power of the signal generated by the microphone at a first harmonic of the test frequency, the stop frequency corresponding to a test frequency to which a correction frequency is added and at which the power of the signal generated by the microphone is at a maximum; and;

generating the correction frequency as a function of the power of the signal generated by the microphone at the test frequency at which the power of the signal generated by the microphone is at the maximum and as a function of the power of the signal generated by the microphone at at least one test frequency next to the test frequency at which the power of the signal generated by the microphone is at the maximum;

wherein the correction frequency is generated in the correction frequency generating step in accordance with:

$$fkorr=\Delta f*(Pneighright-Pneighleft)/(Pmax+|Pneighright Pneighleft|),$$

wherein:

fkorr represents the correction frequency;

Δf represents a spacing between two test frequencies;

Pmax represents the power of the signal generated by the microphone at the test frequency at which the power of the signal generated by the microphone is at the maximum;

Pneighright represents the power of the signal generated by the microphone at a test frequency directly above the test frequency at which the power of the signal generated by themicrophone is at the maximum; and Pneighleft represents the power of the signal generated by the microphone at a test frequency directly below the test frequency at which the power of the signal generated by the microphone is at the maximum.

29. A device for operating a voice-enhancement system, comprising:

at least one microphone;

at least one loudspeaker configured to reproduce a signal generated by the microphone;

a bandpass filter configured between the microphone and the loudspeaker; and a decision logic configured to adjust the bandpass filter one of as a function of a comparison between a power of the signal generated by the microphone at a test frequency and the power of the signal generated by the microphone at an at least substantially integral multiple of the test frequency and as a function of a comparison between the power of the signal generated by the microphone at the test frequency and the power of the signal generated by the microphone at the test frequency at at least an earlier point in time.

30. The device according to claim 29, wherein the bandpass filter includes one of a filter bank and a multifilter having at least one notch filter.

31. A method for operating a voice-enhancement system including at least one microphone, at least one loudspeaker configured to reproduce a signal generated by the microphone, and a bandpass filter configured between the microphone and the loudspeaker, comprising:

defining a power of the signal generated by the microphone at at least three test frequencies;

ascertaining whether feedback exists by evaluating the power of the signal generated by the microphone at the test frequencies; and setting the bandpass filter to block a component of the signal generated by the microphone that exists around a stop frequency when it is ascertained in the ascertaining step that feedback exists.

32. The method according to claim 31, wherein the voice-enhancement system includes at least one of a communication device, an intercom device, a two-way intercom device and a duplex telephony device in a motor vehicle.

33. The method according to claim 31, wherein the stop frequency corresponds to the test frequency at which the power of the signal generated by the microphone is at a maximum.

34. The method according to claim 31, wherein the stop frequency correspond to the test frequency to which a correction frequency is added and at which the power of the signal generated by the microphone is at a maximum.

35. The method according to claim 34, further comprising generating the correction frequency as a function of the power of the signal generated by the microphone at the test frequency at which the power of the signal generated by the microphone is at the maximum and as a function of the power of the signal generated by the microphone at at least one test frequency existing next to the test frequency at which the power of the signal generated by the microphone is at the maximum.

36. A method for operating a voice-enhancement system including at least one microphone, at least one loudspeaker configured to reproduce a signal generated by the microphone, and a bandpass filter configured between the microphone and the loudspeaker, comprising:

defining a power of the signal generated by the microphone at at least three test frequencies;

ascertaining whether feedback exists by evaluating the power of the signal generated by the microphone at the test frequencies;

setting the bandpass filter to block a component of the signal generated by the microphone that exists around a stop frequency when it is ascertained in the ascertaining step that feedback exists, the stop frequency corresponding to the test frequency to which a correction frequency is added and at which the rower of the signal generated by the microphone is at a maximum; and generating the correction frequency as a function of the power of the signal generated by the microphone at the test frequency at which the power of the signal generated by the microphone is at the maximum and as a function of the rower of the signal generated by the microphone at at least one test frequency existing next to the test frequency at which the power of the signal generated by the microphone is at the maximum;

wherein the correction frequency is generated in the correction frequency generating step in accordance with:

$$fkorr=sign*fdist*Pmaxneigh/(Pmax+Pmaxneigh),$$

wherein:

fkorr represents the correction frequency;

fdist represents a spacing between the test frequency at which the power of the signal generated by the microphone is at the maximum and a test frequency having a greatest power directly next to the test frequency at which the power of the signal generated by the microphone is at the maximum;

Pmax represents the power of the signal generated by the microphone at the test frequency at which the power of the signal generated by the microphone is at the maximum;

Pmaxneigh represents the power of the signal generated by the microphone at which the test frequency having the greatest power directly next to the test frequency at which the power of the signal generated by the microphone is at the maximum; and sign represents an algebraic sign; and wherein sign is positive when the test frequency having the greatest power directly next to the test frequency at which the power of the signal generated by the microphone is at the maximum is greater than the test frequency at which the power of the signal generated by the microphone is at the maximum, sign otherwise negative.

37. A method for operating a voice-enhancement system including at least one microphone, at least one loudspeaker configured to reproduce a signal generated by the microphone, and a bandpass filter configured between the microphone and the loudspeaker, comprising:

defining a power of the signal generated by the microphone at at least three test frequencies;

ascertaining whether feedback exists by evaluating the power of the signal generated by the microphone at the test frequencies;

setting the bandpass filter to block a component of the signal generated by the microphone that exists around a stop frequency when it is ascertained in the ascertaining step that feedback exists, the stop frequency corresponding to the test frequency to which a correction frequency is added and at which the rower of the signal generated by the microphone is at a maximum; and generating the correction frequency as a function of the power of the signal generated by the microphone at the test frequency at which the power of the signal generated by the microphone is at the maximum and as a function of the rower of the signal generated by the microphone at at least one test frequency existing next to the test frequency at which the power of the signal generated by the microphone is at the maximum;

wherein the correction frequency is generated in the formed in accordance with:

$$fkorr=\Delta f*(Pneighright-Pneighleft)/(Pmax+|Pneighright-Pneighleft|,$$ wherein:

fkorr represents the correction frequency;

Δf represents a spacing between two test frequencies;

Pmax represents the power of the signal generated by the microphone at the test frequency at which the power of the signal generated by the microphone is at the maximum;

Pneighright represents the power of the signal generated by the microphone at a test frequency directly above the test frequency at which the power of the signal generated by the microphone is at the maximum; and Pneighleft represents the power of the signal generated by the microphone at a test frequency directly below the test frequency at which the power of the signal generated by the microphone is at the maximum.

38. The method according to claim 31, wherein spacings between at least some of the test frequencies are equidistant.

39. The method according to claim 31, wherein spacings between the test frequencies are equidistant.

40. The method according to claim 31, wherein the existence of feedback as ascertained in the ascertaining step only when the power of the signal generated by the microphone at the test frequency at which the power of the signal generated by the microphone is at a maximum is greater by more than an upper limiting value than the power of the signal generated by the microphone at a first harmonic of test frequency at which the power of the signal generated by the microphone is at the maximum.

41. The method according to claim 40, wherein the upper limiting value is between 20 dB and 40 dB.

42. The method according to claim 41, wherein the upper limiting value is approximately 30 dB.

43. The method according to claim 31, wherein a non-existence of feedback is ascertained in the ascertaining step when the power of the signal generated by the microphone at the test frequency at which the power of the signal generated by the microphone is at a maximum is greater by less than a lower limiting value than the power of the signal generated by the microphone at a first harmonic of the test frequency at which the power of the signal generated by the microphone is at the maximum.

44. The method according to claim 43, wherein the lower limiting value is between 5 dB and 20 dB.

45. The method according to claim 44, wherein the lower limiting value is approximately 12 dB.

46. The method according to claim 31, wherein the existence of feedback is ascertained in the ascertaining step only when the power of the signal generated by the microphone at the test frequency at which the power of the signal generated by the microphone is at a maximum is increasing at least approximately exponentially.

47. The method according to claim 31, wherein the existence of feedback is ascertained in the ascertaining step only when the power of the signal generated by the microphone is greater at at least one test frequency than a response threshold for longer than a first response time.

48. The method according to claim 45, wherein the first response time is greater than approximately 750 ms.

49. The method according to claim 31, wherein the existence of feedback is ascertained in the ascertaining step only when the power of the signal generated by the microphone at at least one of the test frequencies is greater for longer than a second response time than the power of the signal generated by the microphone at every other test frequency.

50. The method according to claim 49, wherein the second response time is greater than approximately 750 ms.

51. The method according to claim 31, further comprising repeating the setting of the bandpass filter at the earliest following a minimum response time.

52. The method according to claim 51, wherein the minimum response time is 100 ms to 300 ms.

53. The method according to claim 31, wherein the power of the signal generated by the microphone is defined in the defining step at at least fifty test frequencies.

54. The method according to claim 53, wherein the power of the signal generated by the microphone is defined in the defining step at 150 to 300 test frequencies.

55. A device for operating a voice-enhancement system, comprising:

at least one microphone;

at least one loudspeaker configured to reproduce a signal generated by the microphone;

a bandpass filter configured between the microphone and the loudspeaker; and a decision logic configured to define a power of the signal generated by the microphone at at least three test frequencies, configured to ascertain a possible feedback by evaluation of the power of the signal generated by the microphone at the test frequencies, and configured to set the bandpass filter to block a component of the signal generated by the microphone that exists around a stop frequency in accordance with an ascertainment that feedback exists.

56. The device according to claim 55, wherein the bandpass filter includes one of a filter bank and a multifilter having at least one notch filter.

* * * * *